US010234092B2

(12) United States Patent
Huang

(10) Patent No.: US 10,234,092 B2
(45) Date of Patent: Mar. 19, 2019

(54) IMITATION FLAME LAMP HEAD AND FLICKERING IMITATION FLAME LAMP

(71) Applicant: Guozeng Huang, Dongguan (CN)

(72) Inventor: Guozeng Huang, Dongguan (CN)

( * ) Notice: Subject to any disclaimer, the term of this patent is extended or adjusted under 35 U.S.C. 154(b) by 0 days.

(21) Appl. No.: 15/698,182

(22) Filed: Sep. 7, 2017

(65) Prior Publication Data

US 2017/0370541 A1 Dec. 28, 2017

(30) Foreign Application Priority Data

Jun. 27, 2017 (CN) ..... 2017 1 0511881
Jul. 18, 2017 (CN) ..... 2017 1 0586586

(51) Int. Cl.

| | |
|---|---|
| ***F21V 5/00*** | (2018.01) |
| ***F23D 3/16*** | (2006.01) |
| ***F21S 10/04*** | (2006.01) |
| ***F21S 6/00*** | (2006.01) |
| *F21Y 115/10* | (2016.01) |
| *F21S 9/02* | (2006.01) |
| *F21W 121/00* | (2006.01) |

(52) U.S. Cl.
CPC ..... *F21S 10/046* (2013.01); *F21S 6/001* (2013.01); *F21S 9/02* (2013.01); *F21W 2121/00* (2013.01); *F21Y 2115/10* (2016.08)

(58) Field of Classification Search
USPC ..... 362/569
See application file for complete search history.

(56) References Cited

U.S. PATENT DOCUMENTS

| | | | | |
|---|---|---|---|---|
| 2015/0036348 | A1* | 2/2015 | Dong | F21S 10/046 362/293 |
| 2016/0146414 | A1* | 5/2016 | Dong | F21S 10/046 362/232 |
| 2017/0307159 | A1* | 10/2017 | Li | F21S 10/046 |
| 2018/0283633 | A1* | 10/2018 | Roberts | F21S 10/04 |

* cited by examiner

*Primary Examiner* — Tuyen K Vo
(74) *Attorney, Agent, or Firm* — Shimokaji IP

(57) ABSTRACT

An imitation flame lamp head includes a mounting base, a drive device, an elastic shaft, a flame piece and an illuminant. The drive device is fixed in the mounting base, an upper end of the elastic shaft is fixed to a lower end of the flame piece, the flame piece is protruded outwards the mounting base, the illuminant is configured inside the mounting base to emit lights to a side of the flame piece, and the elastic shaft is driven by the drive device to actuate the flame piece to swing. The lamp displays flaming and flickering effect of faux flame to achieve an excellent imitation effect.

9 Claims, 5 Drawing Sheets

IMITATION FLAME LAMP HEAD AND FLICKERING IMITATION FLAME LAMP

RELATED APPLICATIONS

This application claims the benefits of Chinese Patent Application No. 201710511881.7, filed on Jun. 27, 2017, and No. 201710586586.8, filed on Jul. 18, 2017, the entire contents of which are hereby incorporated by reference in this application.

FIELD OF THE INVENTION

The present invention relates to an imitation flame lamp, and more particularly to an imitation flame lamp head.

BACKGROUND OF THE INVENTION

Currently, for creating ambience in certain occasions, people often use imitation candle lamps to imitate actual candle flame effect. A conventional imitation candle lamp commonly utilizes a flame piece supported on the lamp head, an illuminator emitting light to the flame piece, and a drive device for driving the flame piece to swing, thereby obtaining faux flame effect. However, the flame piece is supported on the lamp head by a wire, and the flame piece may swing at small amplitude due to its swing is limited by the wire. Thus the imitation effect is stiff and not lifelike.

SUMMARY OF THE INVENTION

One objective of the present invention is to provide an imitation flame lamp head which displays flaming and flickering effect of faux flame to achieve an excellent imitation effect.

Another objective of the present invention is to provide a flickering imitation flame lamp which displays flaming and flickering effect of faux flame to achieve an excellent imitation effect.

To achieve the mentioned above objectives, an imitation flame lamp head includes a mounting base, a drive device, an elastic shaft, a flame piece and an illuminant. The drive device is fixed in the mounting base, an upper end of the elastic shaft is fixed to a lower end of the flame piece, the flame piece is protruded outwards the mounting base, the illuminant is configured inside the mounting base to emit lights to a side of the flame piece, and the elastic shaft is driven by the drive device to actuate the flame piece to swing.

In comparison with the prior art, the elastic shaft is configured at the output end of the motor, and the flame piece is connected to the upper end of the elastic shaft. Based on these configurations, if the drive device is rotated intermittently, the elastic shaft and the flame piece will be rotated intermittently as well, at the same time, the flame piece will be swung randomly by the action of the elastic restoring force of the elastic shaft. Specifically, the illuminant emits lights on the flame piece which swings randomly to form a light spot whose position and size will be varied with the swing of the flame piece, thus, such a light spot looks like a flaming center of an actual candle, and the flame piece looks like an actual flaming and flickering candle under a breeze.

Preferably, the drive device is a motor which has an output end connected to a lower end of the elastic shaft.

Preferably, the flame piece is a multi-leaf flame piece.

Preferably, an eccentric wheel is provided at the output end of the motor, and the eccentric wheel has a center shaft fixed to an output shaft of the motor and an eccentric shaft fixed to the lower end of the elastic shaft.

Preferably, the multi-leaf flame piece includes at least one leaf whose area is larger than the others.

Preferably, the drive device comprises a coil, a coil support, a magnet and a connection arm, the lower end of the elastic shaft is connected to the coil support, one end of the connection arm is connected with the elastic shaft or the flame piece, another end of the connection arm is fixed to the magnet, and the magnet is located above the coil.

Preferably, the elastic shaft is a spring, an elastic rubber or silicone.

Preferably, the lamp head further includes a circuit board which is configured at a bottom surface of the mounting base and electrically connected to the drive device and the illuminant.

A flickering imitation flame lamp includes a candle cylinder and the imitation flame lamp head mentioned above. The candle cylinder is a hollow structure, a fixing hole is provided at a top surface of the candle cylinder, the imitation flame lamp head is configured in the fixing hole, the flame piece is protruded outwards the top surface of the candle cylinder, and a power supply is provided at a bottom of the candle cylinder to electrically connect with the imitation flame lamp head.

A flickering imitation flame lamp includes a bulb shell, a bulb holder and the imitation flame lamp head mentioned above. The imitation flame lamp head is configured in the bulb holder and electrically connected with two electrodes of the bulb holder, the flame piece is protruded outwards the bulb holder, and the bulb shell is installed on the bulb holder to cover the flame piece.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
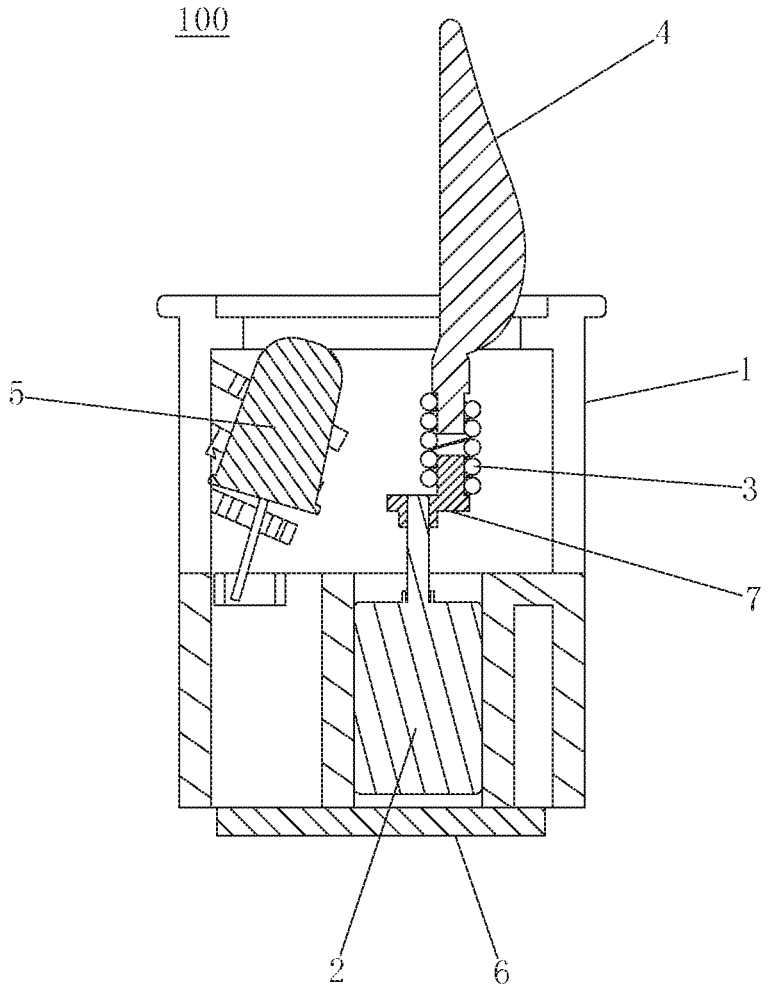
FIG. 1 is a sectional view of an imitation flame lamp head according to an embodiment of the present invention.

As illustrated in FIG. 1, an imitation flame lamp head 100 of the present invention includes a mounting base 1, a motor 2, an elastic shaft 3, a multi-leaf flame piece 4, an illuminant 5 and a circuit board 6. The mounting base 1 includes a left part and a right part. The motor 2 is fixed in the mounting base 1 and has an output end that is upward configured. Specifically, an eccentric wheel 7 is provided at the output end of the motor 2, and the eccentric wheel 7 has a center shaft fixed to an output shaft of the motor 2 and an eccentric shaft (not shown) fixed to the lower end of the elastic shaft 3. The elastic shaft 3 is configured vertically, the upper end of the elastic shaft 3 is fixed to the lower end of the flame piece 4, and the flame piece 4 is protruded outwards the mounting base 1. The illuminant 5 is configured in the mounting base 1 to emit lights to a side of the flame piece 4, and the illuminant 5 is a LED preferably. The circuit board 6 is configured at the bottom surface of the mounting base 1 and electrically connected with the illuminant 5.

The elastic shaft 3 is a spring, an elastic rubber or silicone. In this embodiment, the elastic shaft 3 is a spring.

The multi-leaf flame piece 4 includes at least one leaf whose leaf area is larger than that of the others, that is, the leaf area for each leaf of the multi-leaf flame piece 4 is different, thus the faux flame appearance formed on the leaf may be changed when the flame piece 4 is rotated, therefore the faux flame effect is enhanced. In this embodiment, the multi-leaf flame piece 4 uses three leafs.

By comparison with the prior arts, the eccentric wheel 7 is configured at the output end of the motor 2, the elastic shaft 3 is configured at the eccentric shaft of the eccentric wheel 7, and the flame piece 4 is connected with the upper end of the elastic shaft 3. Since the eccentric wheel 7 and the output end of the motor 2 is not arranged in the same line, thus the flame piece 4 can be rotated significantly when the motor 2 is rotated continuously or intermittently. Furthermore, under the case of that the motor 2 is rotated intermittently, the elastic shaft 3 and the flame piece 4 will be rotated intermittently as well, at the same time, the flame piece 4 will be swung randomly by the action of the elastic restoring force of the elastic shaft 3. Specifically, the illuminant 5 emits lights on the flame piece 4 which swings randomly, to form a light spot whose position and size will be varied with the swing of the flame piece, thus, such a light spot looks like a flaming center of an actual candle, and the flame piece 4 looks like an actual flaming and flickering candle under a breeze. Furthermore, the elastic shaft 3 can imitate a candle wick, thus the imitation effect is excellent. In addition, since the multi-leaf flame piece 4 has three leafs which are arranged in a certain angle, thus at least one leaf will be shown at every view angle; and the multi-leaf flame piece 4 is transparent or translucent, thus the appearance of the faux flame can be shown at every view angle to enhance the esthetics and ornamental. Furthermore, differing from the conventional faux flame, the elastic shaft 3 in this invention is directly fixed to the output of the motor 2, instead of a wire connection, thus the candle lamp can be run normally if it's placed on any position, thereby improving the applicability.

The imitation flame lamp head 100 according to the first embodiment may be installed on different lamp fixtures to form imitation candle lamps.

Figure 2:
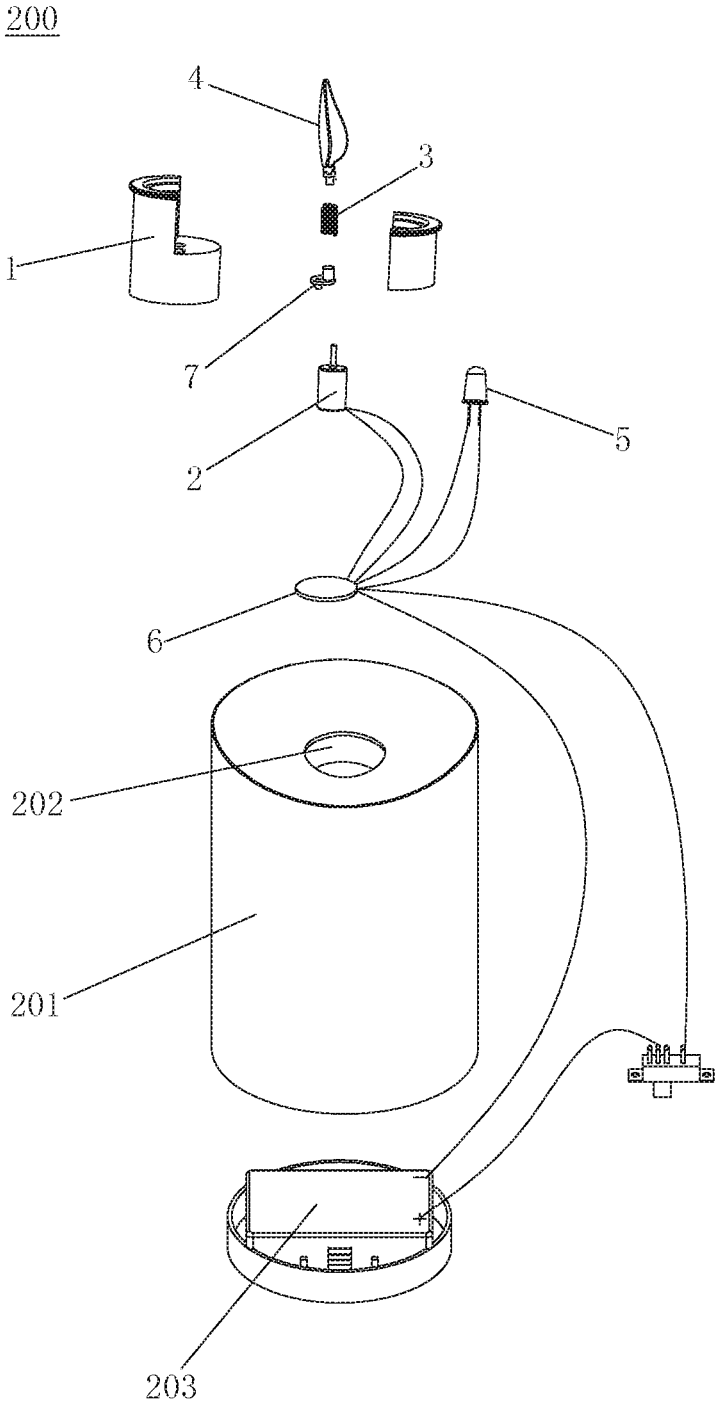
FIG. 2 is an exploded view of a flickering imitation flame lamp according to an embodiment of the present invention.

As shown in FIG. 2, the imitation flame lamp head 100 is installed on a candle cylinder 201 to form a flickering imitation flame lamp 200. Specifically, the flickering imitation flame lamp 200 includes a candle cylinder 201 and the imitation flame lamp head 100, the candle cylinder 201 is a hollow structure, a fixing hole 202 is provided at a top surface of the candle cylinder 201, the imitation flame lamp head 100 is configured in the fixing hole 202, and the flame piece 4 is protruded outwards the top surface of the candle cylinder 201. A power supply 203 is provided at a bottom of the candle cylinder 201, two electrodes of the power supply 203 is electrically connected with two electrodes of the circuit board 6 via a switch, by means of the circuit board 6, the motor 2 and the illuminant 5 are controlled.

Figure 3:
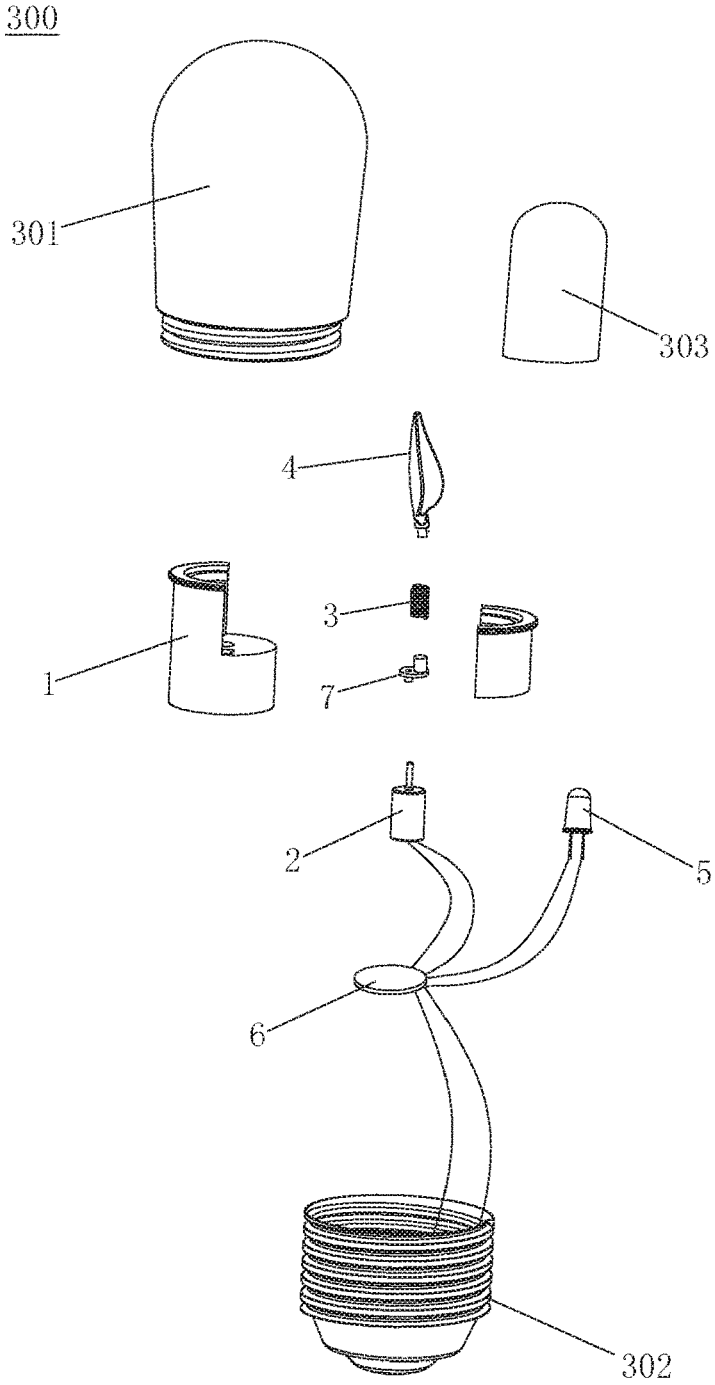
FIG. 3 is an exploded view of a bulb of the flickering imitation flame lamp according to an embodiment of the present invention.
Figure 4:
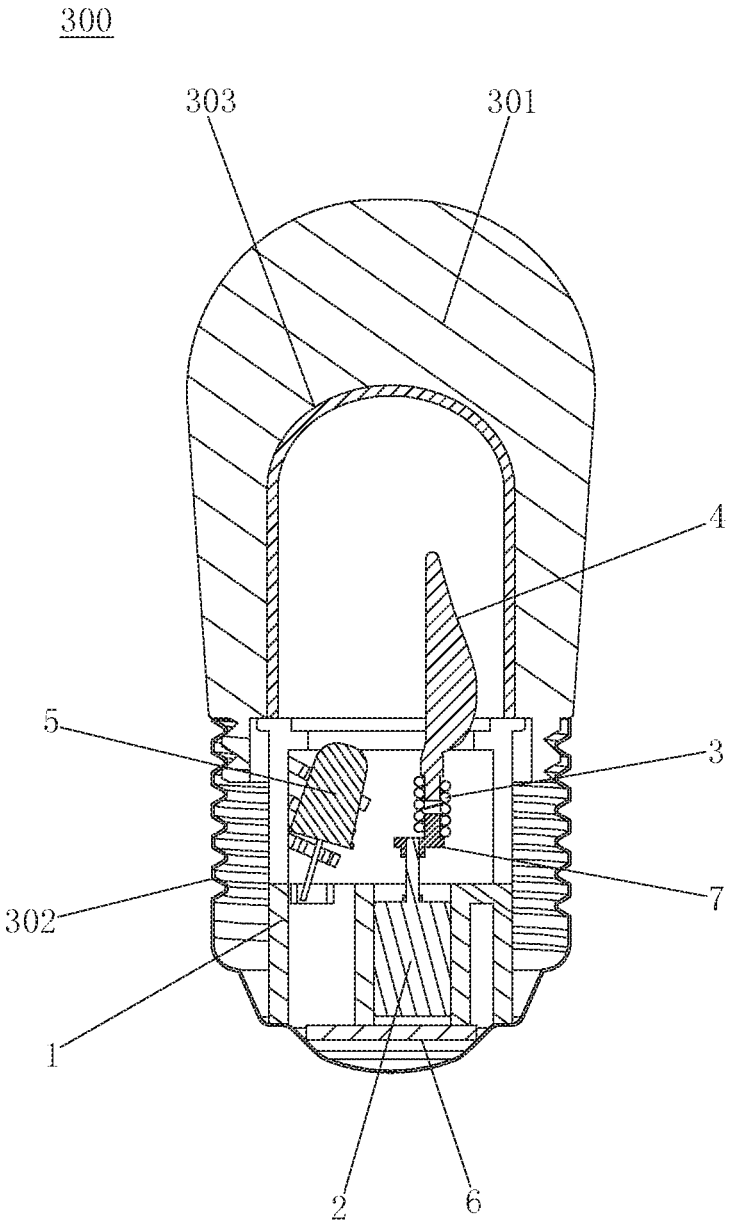
FIG. 4 is sectional view of a bulb of the flickering imitation flame lamp according to an embodiment of the present invention.

Referring to FIGS. 3 and 4, the imitation flame lamp head 100 is installed in a bulb shell to form a flickering imitation flame bulb 300. The flickering imitation flame bulb 300 includes a bulb shell 301, a bulb holder 302 and the imitation flame lamp head 100. Specifically, the imitation flame lamp head 100 is configured in the bulb holder 302, two electrodes of the circuit board 6 is electrically connected with two electrodes of the bulb holder 302, and the flame piece 4 is protruded towards the bulb holder 302. The bulb shell 301 is installed on the bulb holder 302 to cover the flame piece 4. Further, a lampshade 303 is configured at the inner wall of the bulb shell 301. The structure of the bulb holder 302 is the same with that of the conventional tungsten bulb holder, thus the flickering imitation flame bulb 300 can be installed on various imitation flame lamps.

The imitation flame lamps according to the above embodiments are installed with the imitation flame lamp head 100, thus they can imitate flaming and flickering effect of an actual candle and enhance the esthetics and ornamental as well, which is not repeated here.

Figure 5:
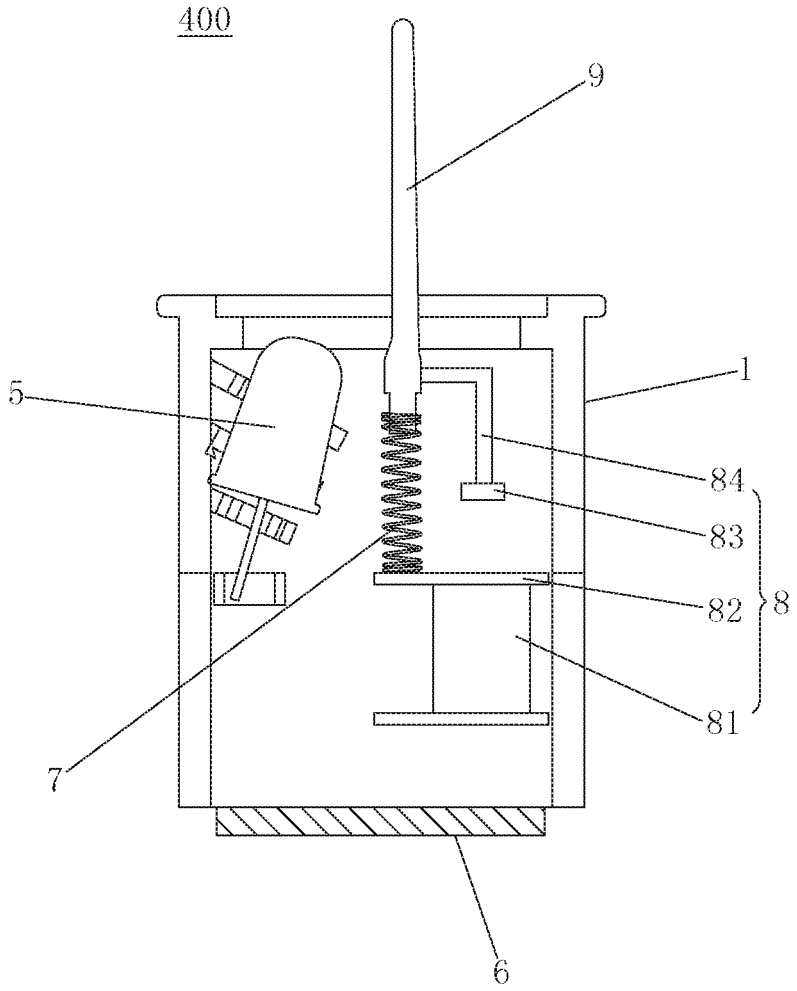
FIG. 5 is a sectional view of an imitation flame lamp head according to another embodiment of the present invention.

Further, as shown in FIG. 5, an imitation flame lamp head according to a second embodiment is disclosed. The imitation flame lamp head 400 in this embodiment includes a mounting base 1, a spring shaft 3, an illuminant 5 and a circuit board 6 which are the same with that in the imitation flame lamp head 100 in the first embodiment, and further includes a drive device 8 and a flame piece 9 which are different from that in the first embodiment. Specifically, the drive device 8 includes a coil 81, a coil support 82, a magnet 83 and a connection arm 84. The lower end of the elastic shaft 3 is connected with the coil support 82, one end of the connection arm 84 is connected with the elastic shaft 3 or the flame piece 9, and the other end of the connection arm 84 is fixed to the magnet 83; while the magnet 83 is located above the coil 81. The flame piece 9 is a single leaf, and the illuminant 5 directly emits lights to the side of the flame piece 9. In this embodiment, the coil 81 is powered up intermittently to generate a magnetic field intermittently, so that the magnet 83 is pushed to actuate the flame piece 9 by means of the connection arm 84. As a result, the flame piece 9 can swing randomly by the action of elastic restoring force of the elastic shaft 3, so as to achieve flickering flame effect. Similarly, the imitation flame lamp head 400 also may be installed on different lamp fixtures to form various imitation flame lamps, which is not repeated here.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An imitation flame lamp head, comprising a mounting base, a drive device, an elastic shaft, a flame piece and an illuminant, wherein the drive device is fixed in the mounting base, an upper end of the elastic shaft is fixed to a lower end of the flame piece, the flame piece is protruded outwards the mounting base, the illuminant is configured inside the mounting base to emit lights to a side of the flame piece, and the elastic shaft is driven by the drive device to actuate the flame piece to swing, wherein an eccentric wheel is provided at an output end of the drive device, and the eccentric wheel has a center shaft fixed to an output shaft of the drive device and an eccentric shaft fixed to the lower end of the elastic shaft.

2. The imitation flame lamp head according to claim 1, wherein the drive device is a motor which has an output end connected to a lower end of the elastic shaft.

3. The imitation flame lamp head according to claim 2, wherein the flame piece is a multi-leaf flame piece.

4. The imitation flame lamp head according to claim 3, wherein the multi-leaf flame piece includes at least one leaf whose area is larger than the others.

5. The imitation flame lamp head according to claim 1, wherein the elastic shaft is a spring, an elastic rubber or silicone.

6. The imitation flame lamp head according to claim 1, further comprising a circuit board which is configured at a bottom surface of the mounting base and electrically connected to the drive device and the illuminant.

7. A flickering imitation flame lamp, comprising a candle cylinder and the imitation flame lamp head according to claim 1, wherein the candle cylinder is a hollow structure, a fixing hole is provided at a top surface of the candle cylinder, the imitation flame lamp head is configured in the fixing hole, the flame piece is protruded outwards the top surface of the candle cylinder, and a power supply is provided at a bottom of the candle cylinder to electrically connect with the imitation flame lamp head.

8. A flickering imitation flame lamp, comprising a bulb shell, a bulb holder and the imitation flame lamp head according to claim 1, wherein the imitation flame lamp head is configured in the bulb holder and electrically connected with two electrodes of the bulb holder, the flame piece is protruded outwards the bulb holder, and the bulb shell is installed on the bulb holder to cover the flame piece.

9. An imitation flame lamp head, comprising a mounting base, a drive device, an elastic shaft, a flame piece and an illuminant, wherein the drive device is fixed in the mounting base, an upper end of the elastic shaft is fixed to a lower end of the flame piece, the flame piece is protruded outwards the mounting base, the illuminant is configured inside the mounting base to emit lights to a side of the flame piece, the elastic shaft is driven by the drive device to actuate the flame piece to swing; and the drive device comprises a coil, a coil support, a magnet and a connection arm, the lower end of the elastic shaft is connected to the coil support at a connection point, one end of the connection arm is connected with the elastic shaft or the flame piece, another end of the connection arm is fixed to the magnet, the magnet is located above the coil, and the connection point of the lower end of the elastic shaft and the coil support deviates from a center axis of the coil by a certain distance.

* * * * *